United States Patent [19]

Deal

[11] Patent Number: 4,896,445

[45] Date of Patent: Jan. 30, 1990

[54] METHOD FOR REDUCING COSTS AND ENVIRONMENTAL IMPACT OF DREDGING

[76] Inventor: Troy M. Deal, 277 Trismen Ter., Winter Park, Fla. 32789

[21] Appl. No.: 681,071

[22] Filed: Dec. 12, 1984

Related U.S. Application Data

[63] Continuation of Ser. No. 579,805, Feb. 17, 1984, abandoned, which is a continuation of Ser. No. 221,219, Dec. 30, 1980, abandoned.

[51] Int. Cl.[4] ..... E02F 5/28; E02F 3/88

[52] U.S. Cl. ..... 37/195; 37/66

[58] Field of Search ..... 37/58, 54, 72, 195, 37/66; 56/8, 9; 406/157; 405/258, 117, 303

[56] References Cited

U.S. PATENT DOCUMENTS

| | | | |
|---|---|---|---|
| 1,844,348 | 2/1932 | Claybourn et al. | 37/72 X |
| 2,291,909 | 8/1942 | Lindstaedt | 239/507 |
| 2,879,649 | 3/1959 | Elliott | 37/78 X |
| 2,926,437 | 3/1960 | Ellicott, Jr. | 37/72 |
| 3,096,718 | 7/1963 | Anderson | 241/185 A |
| 3,521,387 | 7/1970 | Degelman | 56/9 X |
| 3,738,029 | 6/1973 | Harmon | 37/57 X |
| 3,874,101 | 4/1975 | Cummins | 37/69 |
| 3,916,543 | 11/1975 | Poche | 37/93 |
| 3,962,803 | 6/1976 | O'Brien | 37/189 X |
| 3,964,184 | 6/1976 | Mathieu | 37/78 X |
| 3,971,148 | 7/1976 | Deal | 56/9 X |
| 4,104,813 | 8/1978 | Lindsey | 37/66 X |
| 4,193,217 | 3/1980 | Poche | 37/93 |
| 4,261,117 | 4/1981 | Van der Peyl | 37/58 |

FOREIGN PATENT DOCUMENTS

| | | | |
|---|---|---|---|
| 1634762 | 8/1970 | Fed. Rep. of Germany | 37/54 |
| 7410222 | 2/1976 | Netherlands | 37/72 |
| 7703482 | 10/1978 | Netherlands | 37/67 |
| 757649 | 8/1980 | U.S.S.R. | 37/64 |
| 215600 | 5/1924 | United Kingdom . | |
| 949767 | 2/1964 | United Kingdom . | |

OTHER PUBLICATIONS

"New Machine Clears Weed Choked Waterways", *North Port News,* Thursday, Feb. 15, 1979, page fifteen.

Miller, Bill; "Bass Fishing Could be Ruined by Weed Eater", *Fort Myers News-Press,* Sunday, Jun. 3, 1979; p. 9C.

"Water-Weeder Tangles with a Mess", *Land & Water,* Jul., 1979, pp. 18-19.

Wilkens, George; "Citrus Eyes Weed-Eater", *Ocala Star-Banner,* Thursday, Aug. 2, 1979.

Blair-Williams, Judith; "Weed Eating Machine Could Clean Waterways", *Citrus County Chronicle,* Aug. 4, 1979.

Miller, Bill, "Dredged Boat Trails Help Lake Trafford", *Fort Myers News-Press,* Sunday, Sep. 16, 1979, p. 12C.

"Water Weeder is Busy Clearing Canals", *Lehigh News,* Oct. 3, 1979, vol. 17, No. 40.

*Primary Examiner*—Clifford D. Crowder

*Attorney, Agent, or Firm*—Beaman & Beaman

[57] ABSTRACT

Method and apparatus for reducing the cost and environmental impact of excavating and disposing of dredging spoils resulting from the construction and/or maintenance of waterways wherein the reaction of aerially jetting a slurry is used to at least assist in effecting movement of the dredge and the spoil falls as a spray at a distance from the dredge to form a relatively wide and thin dispersal usually laterally disposed to the dredged area.

5 Claims, 7 Drawing Sheets

10
12
14
16
18
22
24
26
28
30
34
35
40
72
74
76
78
108
110
112
122
130
132
134

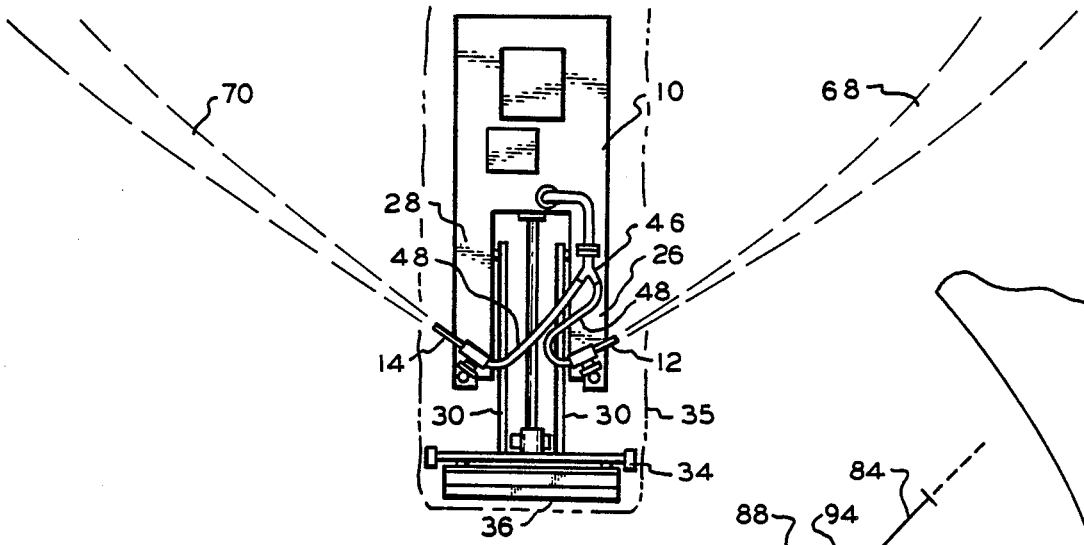
FIG. 5.
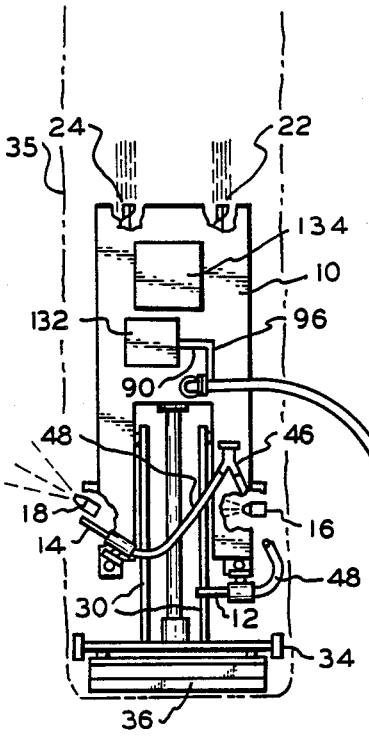
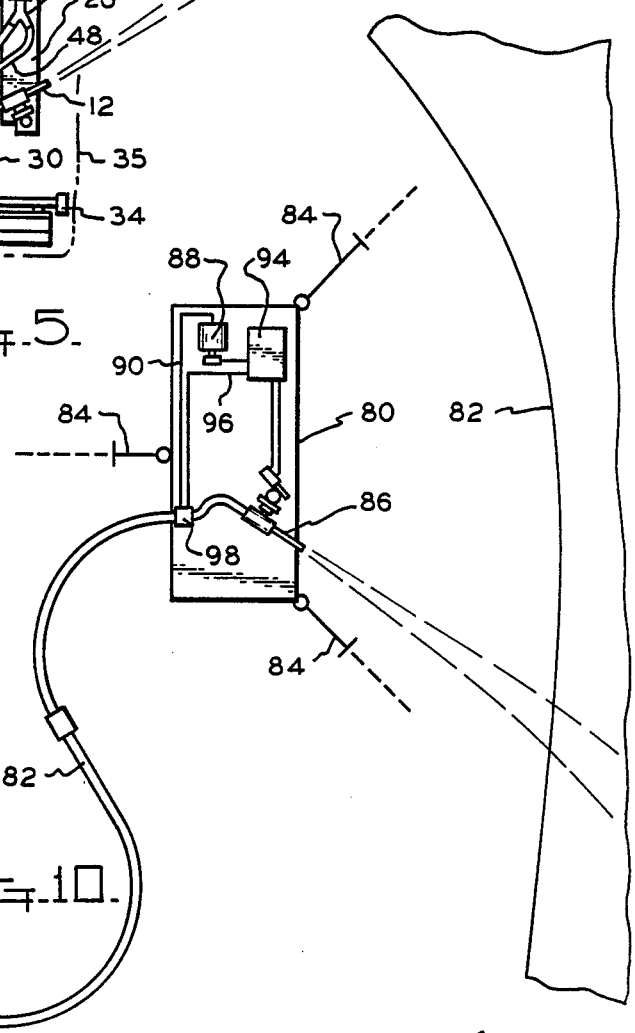
FIG. 10.
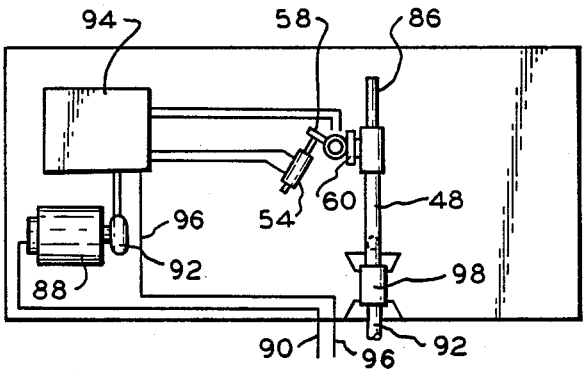
FIG. 12.
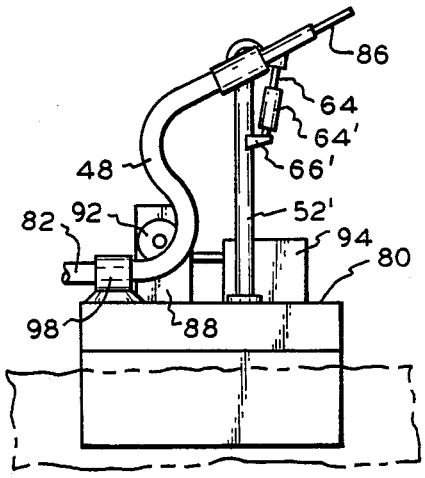
FIG. 11.

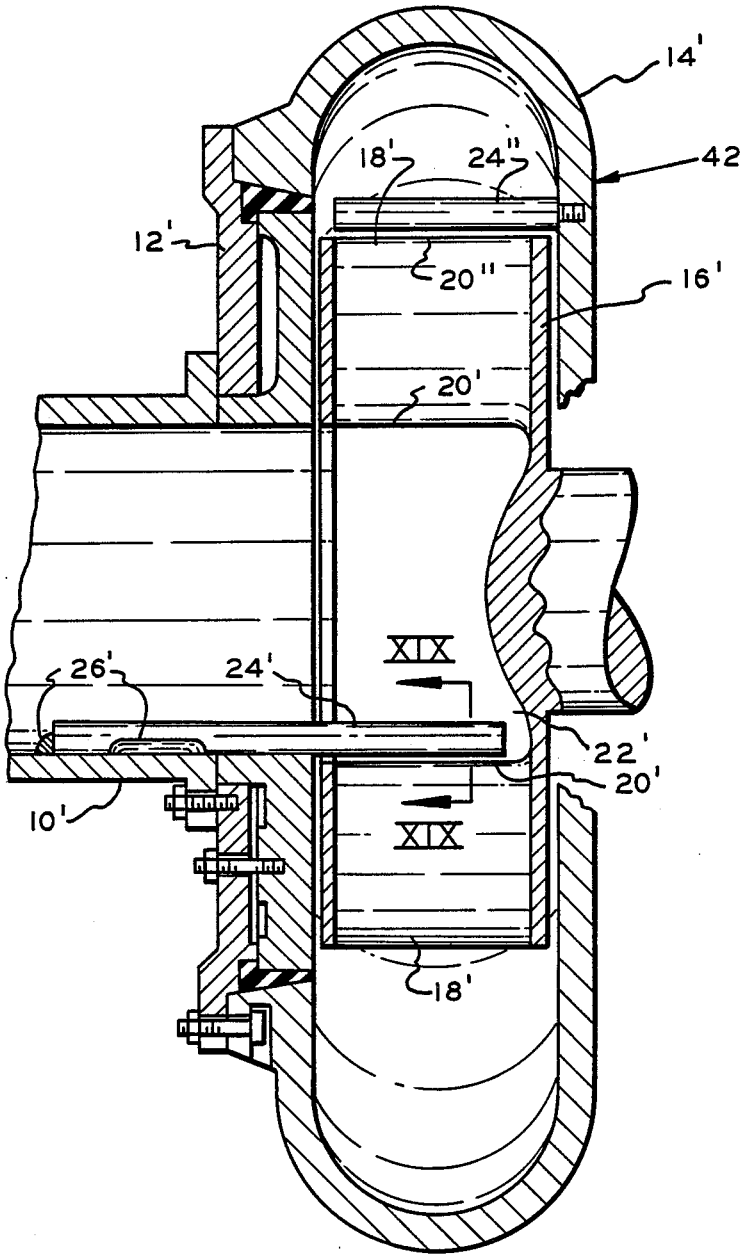
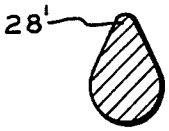
FIG. 19
FIG. 18

METHOD FOR REDUCING COSTS AND ENVIRONMENTAL IMPACT OF DREDGING

NATURE OF THE INVENTION

The present invention relates to method and apparatus for the excavation and disposal of dredging spoils resulting from the construction and/or maintenance of waterways, channels, ditches, slips and the like. In one form it has application to waterways of all kinds regardless of width and depth, the spoil being aerially jetted to fall as a spray to deposit at a distance the same on the surface of land and/or water as a relatively wide and thin sheet usually laterally disposed to the dredged area.

In another form of the invention, the spoil, as a slurry, is pumped through a floating dredge pipe, to a remote jetting barge, for the aerial deposit of the spoil in areas too remote to be reached by being sprayed from the dredge. With this arrangement the reaction of jetting the slurry to at least assist in moving the dredge may be replaced by underwater jets or other forms of propellant.

BACKGROUND OF THE INVENTION

In recent years the environmental impact of constructing and maintaining waterways of all kinds, landfills and drainage has been receiving a great deal of public attention as well as being the subject of extensive governmental regulations. All present forms of dredging and the chemical and mechanical removal of aquatic growths are rapidly becoming unacceptable. Additionally, the cost thereof has increased to an extent that has curtailed proper maintenance resulting in material restriction of navigation and increasing the possibility of widespread flooding due to reduced drainage flow.

Dredging of waterways, channels, ditches and the like has taken many forms. The spoil has been either cast along one or both sides of the dredged area in piled berm at a distance permitted by the length of a boom, trucked or barged to a remote point or pumped to a remote spoil pond, landfill or the like all to the detriment of the environment. In most cases it has not been practical or possible to grade the spoil to avoid unsightly and detrimental land elevation or bars and shoals restricting navigation and natural waterflow, or destructive smothering of fragile marsh lands, etc.

Present dredging practices are particularly harmful to marine life cycles when carried out in tidal waters, salt marshes and the like. Although regulations have been enacted limiting the permitted increase in elevation adjacent dredging operations, it has not been possible to conform to such regulations in many areas and they are being ignored.

Dredging heads capable of supplying a pumpable slurry from the swath area cut by the head are well known. The width of the head may be less than the barge or other form of floating support structure as shown in U.S. Pat. No. 3,412,862 or substantially the same width as disclosed in U.S. Pat. No. 3,962,803. Reference is also made to the applicant's U.S. Pat. No. 3,971,148 as well as to U.S. Pat. No. 3,521,387 to which it relates.

In addition to prolific aquatic plant growth increasingly stimulated by commercial and household nutrients, a continuous buildup of unconsolidated sediment takes place in most waterways and the like in the form of silt, muck, decaying vegetation, etc. Such sediment in time is superimposed upon the natural or dredged profile of the bottom of the waterway restricting and impeding navigation and rate of drainage.

BRIEF DESCRIPTION OF THE INVENTION

According to the present invention a method and apparatus is provided by which the solids of a dredged swath, approximately the width of or of greater width than the floating support structure may be aerially jetted directly or indirectly from the dredge to fall as a spray to deposit the spoil of the swath in a state which has no substantial impact upon the environment.

The dredged swath may be cut through tidal marshlands, wetlands, unconsolidated sediments and other submerged soils capable of being reduced to a slurry which, in addition to being pumped, is also capable of being forced through a restriction nozzle with high velocity to jet the spoil so it may fall as a spray and be spread in a relatively wide, thin sheet remote from and/or laterally of the swath directly adjacent the dredge.

In carrying out one form of the new method of spoil disposal, the projectile and spray pattern of the nozzle structure is such that at the operating pressure of the pumping means, the slurry, in widely dispersed condition, is aerially transferred usually laterally of the longitudinal axis of the dredged swath in the order of 5–15 times the width of the swath, with the spray pattern being controlled by a nozzle diffuser.

Preferably, the nozzle structure reaction provided by the controllable lateral and slightly rearward jetting of the spoil slurry is employed to propel and steer the floating support structure. Under many operating conditions such reaction may be the sole propelling and steering means. Other supplementary means such as auxiliary jets, in and outboard engines driving propellors, tugboats, etc. may be required under severe weather and environmental conditions to provide additional thrust and steering.

As the nozzle reaction is proportional to the rate of slurry flow through the nozzle structure, the forward movement of the floating support structure is reduced when the density of the slurry tends to reduce the flow through the pump and nozzle structure. Thus there is a tendency for the rate of forward movement to be adjusted to the dredging conditions and overloading of the dredging and slurry making at the cutterhead is self-controlled to a substantial extent. This results in a reduction in down time due to clogging of the pump and nozzle structure.

Auxiliary water jets may be provided at the intake to the pump to reduce clogging at the intake. Also protective bars may be used to define a casing about the augers of the cutterhead with teeth located on the cutterhead breaking up hard material for slurry processing.

BRIEF DESCRIPTION OF THE DRAWINGS

The objects and advantages of the invention will be appreciated from the following description and accompanying drawings wherein:

FIG. 9 is a view similar to FIG. 5 showing the nozzle directed to the same side of the dredge, FIG. 10 is a remote jetting of slurry, FIG. 11 is an enlarged end view of the monitor barge of FIG. 10, FIG. 12 is an enlarged side elevation of the monitor barge of FIG. 10.

FIG. 18 is a vertical cross section of the pump, and

FIG. 19 is a section taken on line XIX—XIX of FIG. 18.

DESCRIPTION OF THE PREFERRED METHOD

Figure 2:
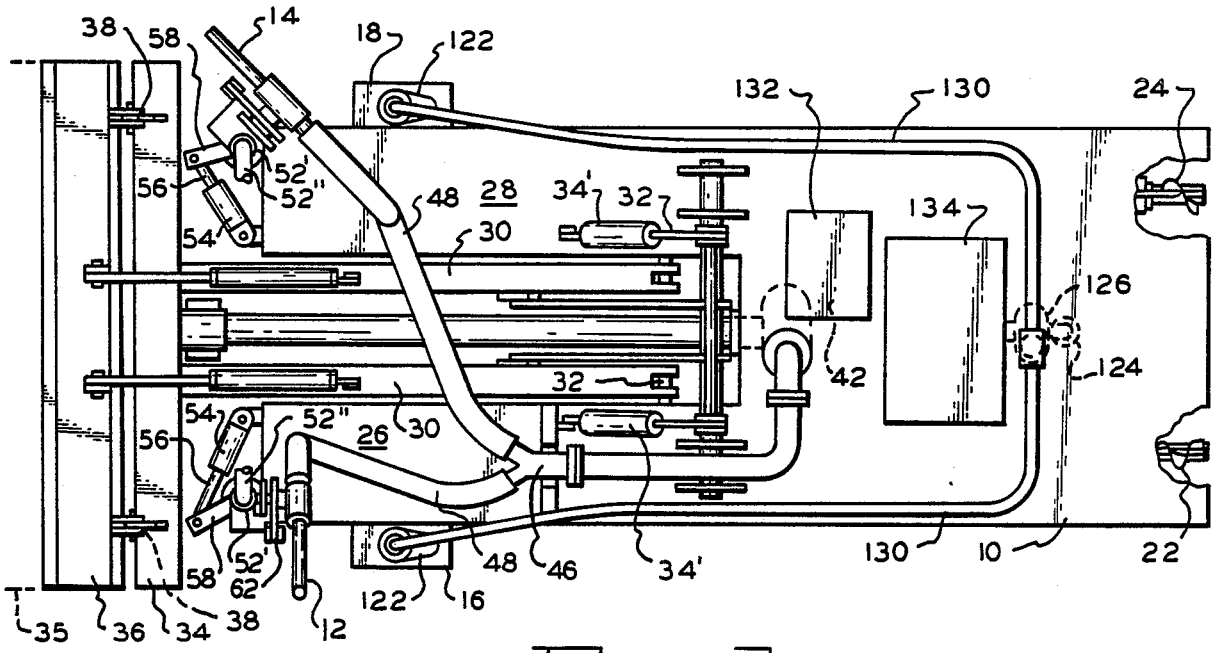
FIG. 2 is a plan view of FIG. 1.

The method hereinafter described has resulted from several years of extensive experimental efforts carried out in numerous localities in the State of Florida and elsewhere in public waters under the supervision of State and Federal departments charged with the regulations of activities that are deemed detrimental to the environment as well as those under the Corps of Engineers. Numerous modifications have been made during this experimental period to adapt to the wide range of variables experienced in different localities as well as along the same waterway. During this development period full disclosures of the progress were communicated to those involved in the licensing and regulation of dredging in public waters and publications relative to such progress appeared in several Florida newspapers and national publications as early as Feb. 15, 1979.

It was found that the density of the slurry of the cut swath was greatly influenced by the rate of movement of the dredge. The initial efforts to employ the reaction of the nozzle to move and steer the floating support were not satisfactory and numerous modifications were made before satisfactory results were obtained. Under some conditions it became necessary to employ auxiliary steering and pushing navigation means to advance the swath cutter.

To be practical, the means for excavating and transferring spoil of a dredging operation must be capable of handling large acreage at low cost and rapidly. Any method employed must be relatively free of shut downs due to clogging, etc. and the results must be relatively uniform to conform to environmental regulations. Pressures, densities, degree of comminution and other variables established in the past to pump spoil through pipes to a point remote from the dredging operation were found to be unsatisfactory in the aerial transfer of the spoil from a nozzle.

EXAMPLE NO. 1

During a recent demonstration of applicant's experimental dredge in Louisiana, approximately 79,000 yards of silt were removed in approximately 30 hours, the spoil being aerially transferred laterally of the swath and lightly spread as a thinly rained ribbon-like layer approximately 100′ wide on each side of the swath. In this test the silt was relatively light with the slurry density being in the order of 5% solids. The pumping pressure was in the order of 40 pounds per square inch and the aerial transfer took place through two 2½″ nozzles equipped with adjustable diffusers. The average rate of travel of the swath cutter was approximately 41 feet per minute during actual operation and excluding down time. Extra thrust and steering control was furnished by an attached push-tugboat.

EXAMPLE NO. 2

When the swath cut in the waterway is heavy with aquatic growths and decaying vegetation the density and the cut length of the fibrous material must be carefully controlled to obtain uniform and continuous aerial transfer of the spoil. Using comminuting cutter bars in the pump as disclosed in my copending application Ser. No. 06/359,432 filed Mar. 18, 1982, a continuation of my application Ser. No. 18,105, filed Mar. 7, 1979 at least 95% of the fibers in the slurry passing the spray nozzles are less than 3 inches in length as determined by numerous authority supervised tests.

DESCRIPTION OF THE PREFERRED EMBODIMENT

The hull of the dredge 10 may take any suitable form capable of providing shallow draft, stability and steerageway under the thrust propelling influence of the adjustable jet nozzles 12 and 14. Auxiliary navigational means may take the form of underwater jets 16 and 18 located forward and on opposite sides of the hull 20 as well as self cleaning screw propellers 22 and 24.

At its forward end the hull 20 is forked to provide hull portions 26 and 28 spaced to receive the two part pivoted boom 30 mounted on the pivot pins 32. At its forward end, the booms 30 carry a dredge cutter head 34 having depth control cylinders 34′ which may conform to that shown in applicant's U.S. Pat. No. 3,971,148 issued July 27, 1976. Cutter head 34 produces a box section trench or swath 35 ahead of the dredge 10 which is preferably at least slightly wider than the hull 20 to allow the dredge 10 to follow the cutter head 34 in all water depths as well as when cutting into uplands.

A hydraulically actuated cutter head shield 36 is shown pivotally supported about the axis 38 carried on the cutter head 34 to provide material confinement. A flexible suction line 40 having a suitable suction sensor 41 extends between the cutter head 34 and the pump 42 which is preferably equipped with shear blades as disclosed in my aforesaid copending application to further comminute the solids in the slurry passing the cutter head 34 to reduce clogging of the system to an acceptable operating level. The sensor 41 assists in the operation of the propellers 22 and 24.

Discharge pipe 44 of the pump 42 has a Y-portion 46 to which are connected flexible conduits 48 extending to the inlet ends of the adjustable jet nozzles 12 and 14. Preferably the nozzles 12 and 14 are located at the forward end of the hull 20 and adjacent the cutter head 34. In practice, this location has been found to provide the best steerageway under jet reaction propulsion and places the jets in the forward view of the operator.

The support structure for the jet nozzles 12 and 14 may comprise brackets 50 located at the front corners of the hull 20 to which fixed rigid vertical posts 52 are mounted. Rotatable sleeves 52′ are carried on the posts 52 and rotated relative to the posts 52 by hydraulic cylinders 54 pivoted to the hull 20 at one end and having rods 56 pivotally connected to brackets 58 fixed to the sleeves 52′. A horizontal brace 52″ provides support for the posts 52 to better carry the reaction of the jet nozzles 12 and 14 and to assist in transferring this reaction to the hull 20.

Supporting the nozzles 12 and 14 for oscillation about horizontal axes are bearing members 60 fixed to the vertical sleeves 52'. Oscillated members 60' are supported in the members 60 to which arms 62 are fixed for pivotal connection to the rods 64 of the hydraulic cylinders 64'; the lower ends of the cylinders 64' being pivoted at 66 to arms 66' fixed to the sleeves 52'. Brackets 60'' fixed to and oscillated with the members 60' are attached to the nozzles 12 and 14.

It has been found in practice that oscillation of the sleeves 52' through an arc in the order of 160° and oscillation of the members 62 through an arc in the order of 105° is adequate for jetting of the slurry as well as for moving and steering the dredge 10. However, it will be understood that the members 60' may be so adjusted that both nozzles 12 and 14 may discharge slurry laterally of the same side of the dredge 10 or the nozzles 12 and 14 may be adjusted to avoid spraying passing traffic, specific areas, etc. along the swath being cut by the cutter head 34.

Figures 5, 6, 7, 8:
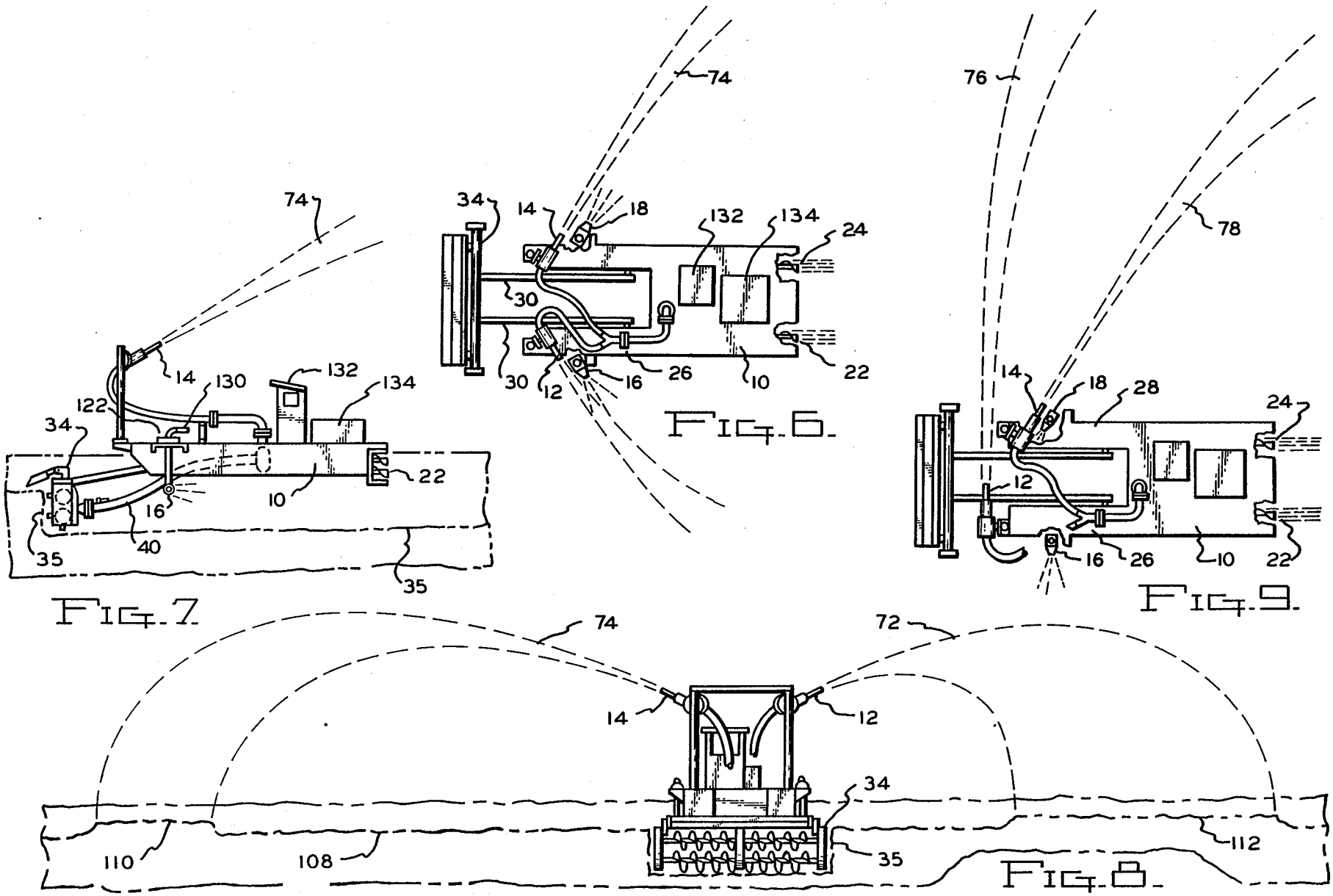
FIG. 5 is a plan view of a waterway showing the relationship between the swath and the area in which the aerial transfer of the spoil takes place.
FIG. 6 is a view similar to FIG. 5 with the nozzles at different pattern adjustment.
FIG. 7 is a side elevation of FIG. 5.
FIG. 8 is a front view of FIG. 5.

As shown in FIG. 5, the nozzles 12 and 14 are directing the dredge spoils to opposite sides of the dredge 10 and the swath being cut by the cutter head 34. The spray pattern 68 of nozzle 12 being shown similar to the pattern 70 of the nozzle 14.

In FIG. 6 the spray pattern 72 of the nozzle 12 is shown substantially different from pattern 74 of the nozzle 14. This difference has resulted from the adjustment of the diffuser or other suitable means as will be hereinafter more fully described. FIG. 7 shows the pattern 74 in side elevation, the nozzle 12 being shown removed for purposes of illustration. In the front elevation of FIG. 8, the spray patterns 72 and 74 may take the form shown when the nozzles 12 and 14 are adjusted as shown in FIG. 6.

FIG. 9 is a view similar to FIG. 6 showing nozzles 12 and 14 both being directed to the same side of the dredge 10 with similar spray patterns 76 and 78, respectively. This arrangement may be used where all the spoils are to be disposed at the same side of the dredged swath such as to avoid docks or other structure, to avoid spraying passing traffic, etc. It will be noted that the jets 16 and 18 are so directed as to oppose the reaction of the nozzles 12 and 14 in the position shown in FIG. 9.

Referring to FIGS. 10–12, when the area in which the dredging spoils are to be disposed is beyond the range of the nozzles on board the dredge 10, the connection between the nozzles 12 and 14 and the pump 42 is broken and a connection is made between the pump 42 and a spray monitor barge 80. This connection may be made through the use of a floating dredge pipe 82 in a well known manner.

As shown in FIG. 10, the barge 80 is held in position by the shore 82 or anchored to dead-men 84. A nozzle 86 is supported on a suitable upright on barge 80 and raised and lowered and swung through an arc in the same manner as described with reference to the nozzle 12 in the description of FIGS. 1–3. In this manner the spoils are disposed on the shore 82.

To remotely control the operation of the spray monitor barge 80 suitable power and control lines from the dredge 10 are carried by the structure floating the pipe 82 to the barge 80. A remotely operated self-contained power unit 88 having a control line 90 supplies the hydraulic system pump 92 for the control unit 94. Suitable solenoid control valves, not shown, for elevating and rotating the nozzle 86 are remotely operated through the control line 96 from the dredge 10.

It will be understood that the spoil to be disposed on the shore 82 is removed from the swath of the cutter head 34, pumped from the dredge 10 through the pipe 82 to the intake 98 of the barge 80 and then under the control of the operator on the dredge 10, the spoil is sprayed on the shore 82 in a relatively wide and thin disposal. In carrying out this step, the dredge 10 continues to employ the thrust augmenting propellors 22 and 24 and the heading control jet system provided by the jets 16 and 18 for propulsion and directional control.

Figure 3:
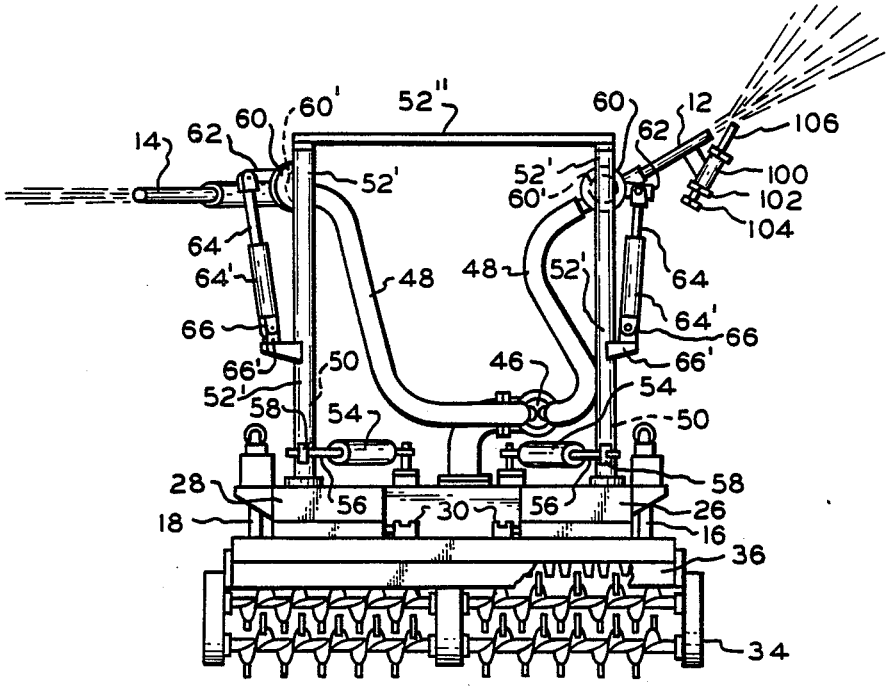
FIG. 3 is a front end view of FIG. 1.
Figure 4:
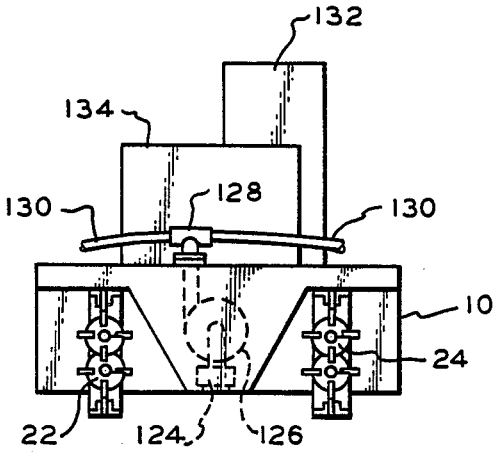
FIG. 4 is a rear end view of FIG. 1.

Referring to FIG. 3, the nozzle 12 is shown equipped with a diffuser 100 which in its simplest form comprises a threaded rod 102 having a knob 104 at one end and point 106 at the outer end which on axial adjustment intersects the jet stream of the nozzle 12 to alter its spray pattern.

In FIGS. 7 and 8 the swath 35 is shown being cut in wet land 108 with the disposal taking place in the areas 110 and 112 on opposite sides of the swath 35. As the spray patterns 72 and 74 are different the widths and amount of buildup of the spoil disposal are likewise different.

Figure 13:
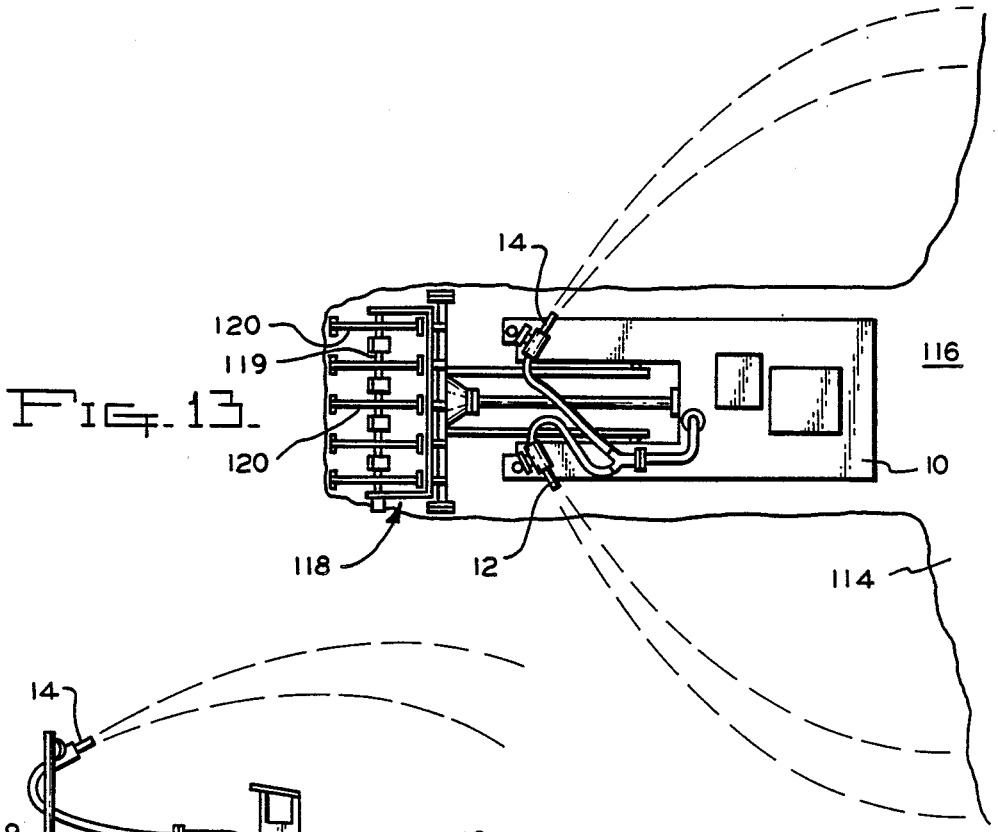
FIG. 13 is a plan view of upland dredging.
Figure 14:
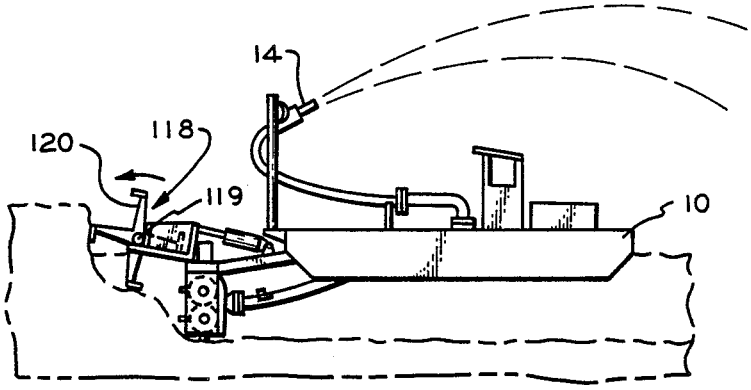
FIG. 14 is a side elevational view of FIG. 13.

FIGS. 13 and 14 illustrate the application of the present development to upland dredging of canals. Here the dredge 10 is being used to dredge a canal connecting with the open water area 114. As shown, the canal 116 is the width of the swath 35 and nozzles 12 and 14 are depositing the dredged material as a thin cover along both sides of the canal with minimum impact upon the environment along the canal 116 and the open water 114.

As shown, a suitable rotary excavation attachment 118 is located forward and above the cutter head 34, being hydraulically rotated counterclockwise to engage and break up the upland. Attachment 118 may take many forms such as having a central, horizontally extended shaft 119 carrying a series of spiders 120 spaced along the shaft and having shovels or the like mounted on the outer ends of the radial arms of the spiders 120. The broken upland material is directed into the path of the cutter head 34 and slurried as it is carried into the inlet of the pump 42 to be sprayed by the nozzles 12 and 14.

To fully appreciate the departure of the method and apparatus for spoils disposal disclosed herein: all previous methods in commercial use involved piping pumped spoils to containment areas creating islands, or casting by boom-bucket to the immediate sides of the excavation creating artificial berms and banks alongside of the excavation. The only other alternative available was to haul the spoils by barge or ship to deep water or remote spot-disposal sites. All of these courses create environmental hazards which are presently unacceptable also. Also, such methods are inflexible and costly.

In practice, the method and apparatus of the present invention involves the slurrying of spoils ahead of the movement of a pump carrying flotation dredge or other means of conveyance; pressurizing the slurry which has been prepared for its passage through restrictive nozzles; passing the slurry through one or more nozzles to provide air-jetting distance capability using controllable diffusion and vertically and horizontally controlled nozzles to provide rain-like thin wide disbursement of spoil-slurry over large areas; such disbursement alongside the excavation being carried out with little, if any, permanent impact upon the environment.

Further, by using the reaction of the air-jetting nozzles 12 and 14 to propel and steer the dredge 10 or to at least assist therein plus providing disposal of the spoils in a continuous movement free of anchors, winching, pipes, etc., great flexibility, speed and cost reductions not previously obtainable are being experienced in demonstrations conducted under the authority of those agencies regulating the use of public waters and wet lands.

Figure 15:
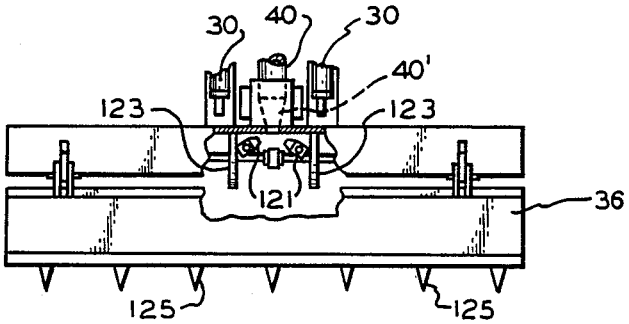
FIG. 15 is a schematic view of a cutterhead having slurry water jets to reduce clogging.

FIG. 15 is a schematic view partially shown in broken section in which water jets 121 are shown directed at the intake 40' of the suction line 40. Suitable trash guards 123 embrace the cutter head 34 (not shown) to protect the same from large objects which might clog the cutter head and/or intake 40'. The water jets 121 will tend to break up material moving toward the intake 40' and reduce any tendency of clogging.

To assist in breaking up the material to be dredged, in FIG. 15 the shield 36 is shown equipped with teeth 125 to enable the same to function in the manner of a back hoe.

HEADING CONTROL JET SYSTEM

Figure 1:
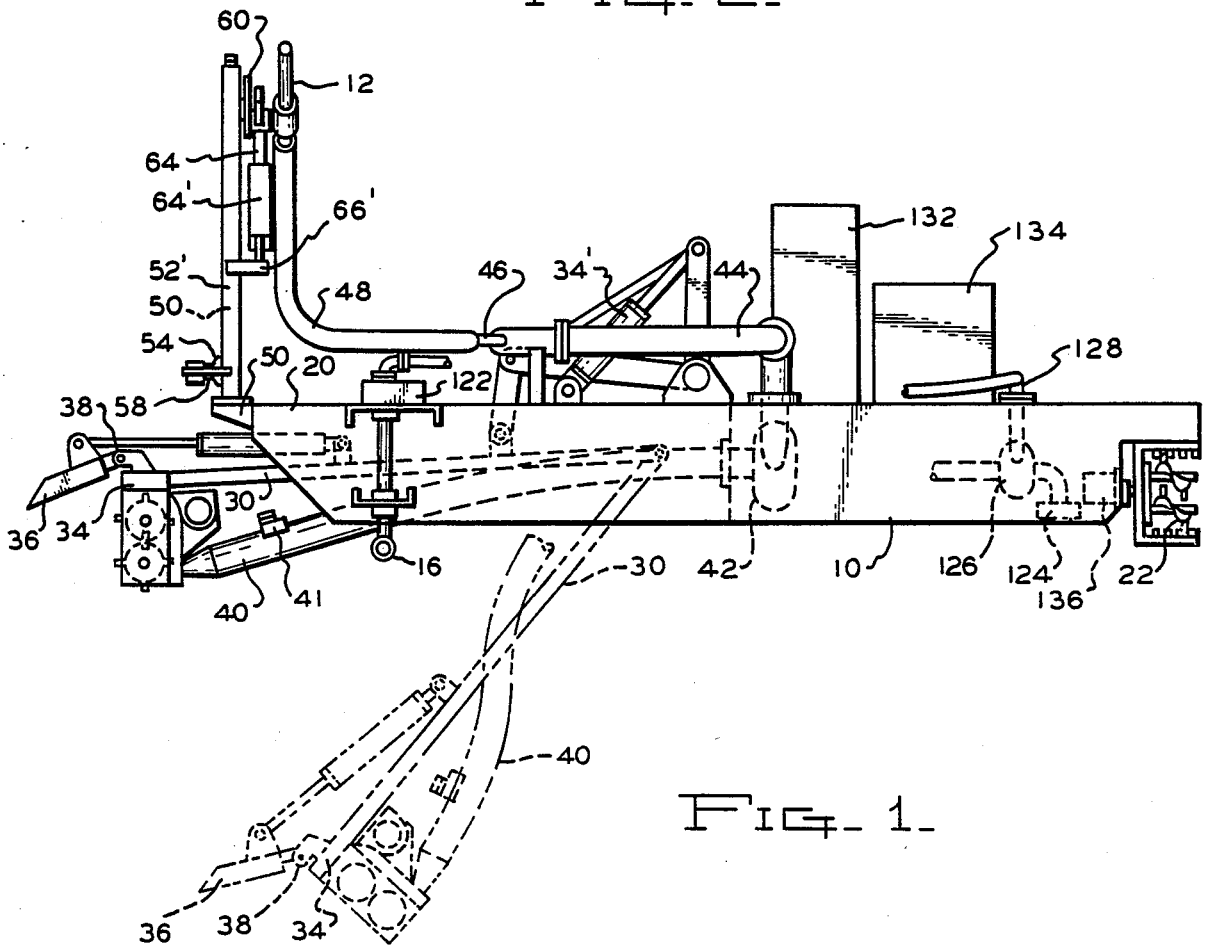
FIG. 1 is a side elevational view of the floating support structure.

The horizontal water jets 16 and 18 of FIGS. 1 and 2 are preferably mounted for rotation through 360° by means of suitable mechanism 122 located at their upper end. In practice, the mechanism 122 may take the form of a 360° positional servomechanism slaved to the magnetic compass of the dredge 10. This provides automatic heading control for navigation and offsets the disposal jet reactive force of the nozzles 12 and 14. The jets 16 and 18 are powered by a separate high pressure water system having an inlet 124, a pump 126 with a Y-discharge 128, and hydraulic lines 130 extending to the jets 16 and 18. Controls and operator for the dredge 10 are housed in the shelter 132 while the operating power for the hydraulic and electric drives for the pumps, etc. are located at 134. The hydraulic drives for the propellers 22 and 24 are indicated at 136.

Figure 16:
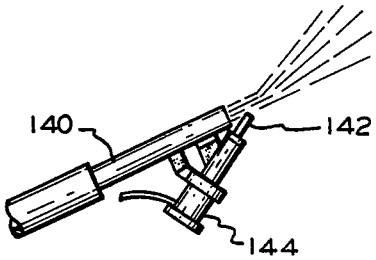
FIG. 16 is an enlarged modification of spray diffuser.

A modified form of the diffuser 100 of FIG. 3 is shown in FIG. 16 in which the diffuser 138 is shown mounted on the spray nozzle 140 corresponding to the nozzles 12 and 14. The axial movement of the control rod 142 which intersects the jet stream to vary the spray pattern is controlled by a suitable stepper motor 144 which in turn is controlled from the shelter 132 by the operator.

SCHEMATIC OF ATTACHMENT CONTROLS

Figure 17:
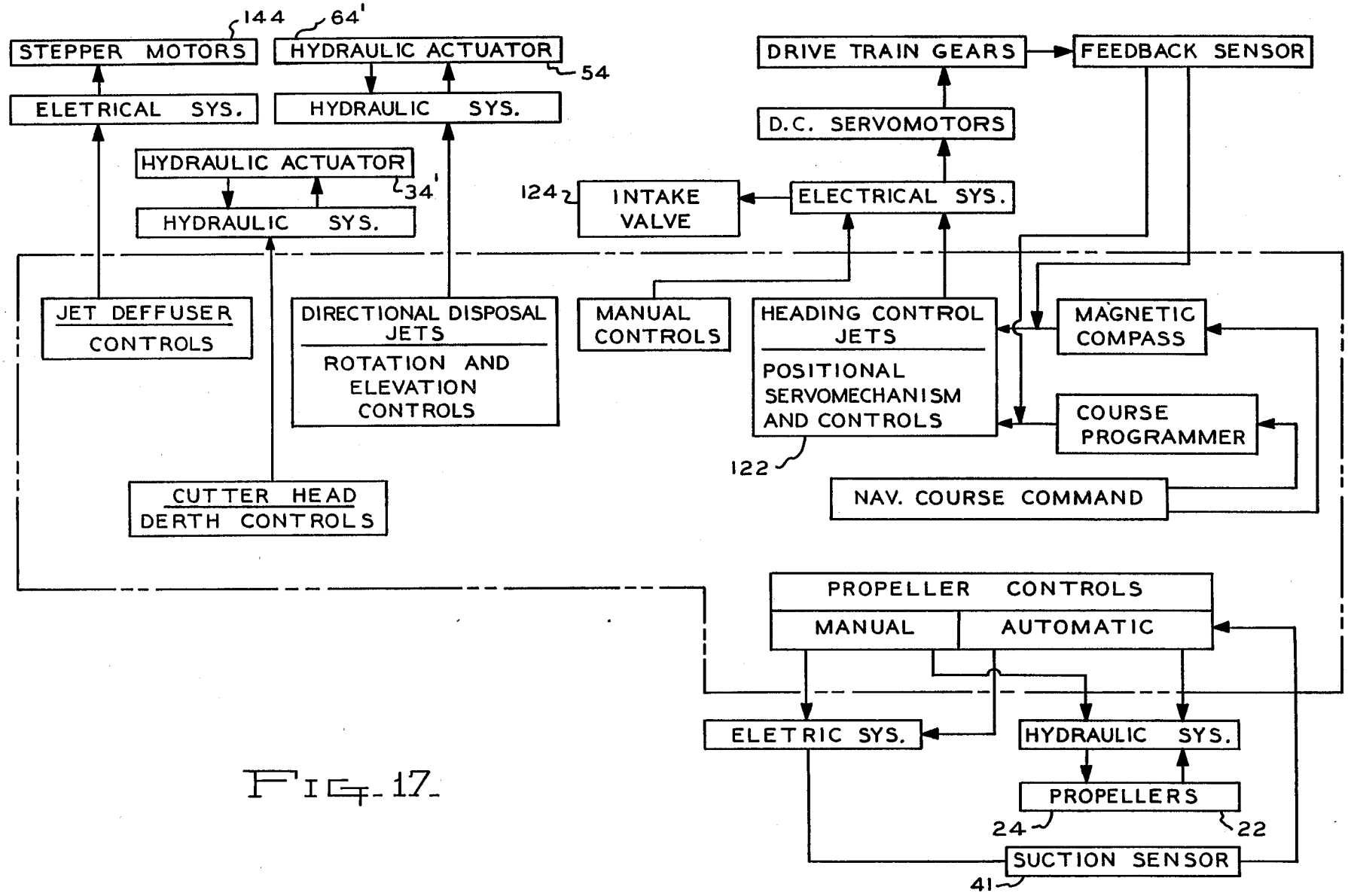
FIG. 17 is a schematic layout of attachment controls.

In FIG. 17 a schematic showing of the attachment controls of the dredge 10 is depicted. In this illustration the various labeled boxes have been indicated by the same reference character of the structure shown in the drawings for carrying out stated function.

Referring to FIGS. 18 and 19, the pump 42' is shown in vertical section. The suction, pipe 40 may be attached to the suction pipe 10' and adapter 12' of the pump housing 14' in which the usual impeller 16' is supported for rotation. The usual radial passage 18' of the impeller 16' have surfaces 20' adjacent the axes of rotation which define the annular intake chamber 22'. At the outer end of the passages 18' surfaces 20'' define the outer annular shape of the impeller 16'.

To provide the impeller 16' with a comminuting function with respect to aquatic growths being moved through the pump housing 14' by rotation of the impeller in the usual manner, it is provided that one or more static shear or cutter elements of suitable size and shape be supported adjacent the surfaces 20' and 20' in shearing relation to the aquatic growth passing through the pump. As illustrated a bar 24' is shown welded at 26' to the pipe 10' and axially projecting into the intake chamber 22' of the impeller 16'. If desired the bar 24' may be welded or otherwise affixed to the adapter 12'. In either case, the projected outer end of the bar 24' will be disposed adjacent the surfaces 20' which define the annular intake chamber 22' as well as the inner terminal of the passage 18'. In this manner, the outer end of the bar 24' is disposed in shearing relation with respect to the surfaces 20' and the passages of aquatic growths entering the passages 18' during rotation of the impeller 16'.

A shear bar 24'' is shown supported from the housing in shearing relation to the surfaces 20'' defining the outer annular shape of the impeller 16' as well as the outer terminal of the passage 18'. As shown, the bar 24'' has a threaded end engaging in a threaded aperture in the housing 14'. As lengths of aquatic growths pass radially through the passages 18' of the impeller 16' they will be carried into a shearing zone provided by surfaces 20''. The amount of comminuting of the aquatic growths taking place at opposite end of the passage 18' during rotation will depend upon the number of bars 24' and 24'' installed. For example a second bar may be affixed to the pipe 10' diametrically opposite the bar 24' shown in FIG. 18.

As indicated above the bars 24' and 24'' may be of any suitable shape and material. If provided with a cutting edge 28' as shown in FIG. 19, the edge should be directed upstream as the lengths of aquatic growths will tend to drape over the edge 28' as the suction draws the lengths in the slurry through the passages 18'.

It will be understood that the clearance between the bars 24' and 24'', and the surfaces 20' and 20'', is a close running clearance capable of shearing the lengths of aquatic growths without interfering with the rotation of the impeller 16'. Obviously the use of the bars 24' and 24'' will increase the power input to the pump required to handle the same volume of slurry.

I claim:

1. A method of transferring the dredging spoils of waterways, channels, ditches and the like with minimum environmental impact on the adjacent land and/or water comprising the steps of cutting a swath of solid spoils with a dredging head, forming a slurry having in the order of 5–10% solids by weight from the water within the swath, directing the slurry into the intake of a pump, reducing the size of the solids to form a sprayable slurry as the slurry passes through the pump while pressurizing the slurry, and passing the sprayable slurry from the pump to restricting nozzle means to accelerate the flow to spray the slurry relative to the swath in the order of 5 to 10 times the width of the swath with a projectile and spray pattern to dispose the spoils in a wide, thin, environmentally acceptable layer remote from the swath.

2. A method as defined in claim 1 wherein said nozzle means takes the form of at least two nozzles for simultaneously spraying the spoil on opposite sides of the swath.

3. A method as defined in claim 1 including the step of diffusing the projectile and spray pattern after the slurry leaves the nozzle means to aid in the disposal of the spoils in a thin environmentally acceptable layer.

4. A method of economically dredging navigable channels in waterways with minimum environmental impact on areas adjacent the channels comprising the steps of cutting a box section swath of solid spoils with continuous movement along the central directional axis of the swath, directing the solids of said waterway swath in the form of a slurry both rearward and toward said axis to deliver said slurry to an embracing intake zone, reducing the solids of said swath to a sprayable slurry mixture having in the order of 5–10% solids by weight as the solids are transferred from the swath to said zone, pressurizing and accelerating said mixture in a confined discharge zone, releasing said slurry mixture to the atmosphere directly adjacent said swath in a direction transverse to the directional axis of said swath while continuously moving along said axis, said mixture being released in the form of a fluid stream with the reduced solids entrained therein in an accelerated state, diffusing said fluid stream, independently moving said fluid stream relative to the movement along said axis in horizontal and vertical directions to vary the distribution of said stream, said stream being discharged along a slightly elevated projectile path and under sufficient pressure and acceleration to aerially distribute said solids over a distance from the swath in the order of 5 to 10 times the width of the swath to dispose the solids as a thin ribbon-like environmentally acceptable layer parallel to the swath, the fluid of the mixture being distributed as a mist over the same area.

5. A method of transferring the dredging spoils of waterways, channels, ditches and the like with minimum environmental impact on the adjacent land and/or water comprising the steps of cutting a swath of solid spoils with a dredging head, forming a slurry having in the order of 5–10% solids by weight from the water within the swath, directing the slurry into the intake of a pump, reducing the size of the solids to form a sprayable slurry as the slurry passes through the pump while pressurizing the slurry, passing the sprayable slurry from the pump to restricting nozzle means to accelerate the flow to spray the slurry relative to the swath in the order of 5 to 10 times the width of the swath with a projectile and spray pattern, and independently moving the nozzle means in horizontal and vertical directions to vary the direction of the projectile and spray pattern to dispose the spoils in a wide, thin, environmentally acceptable layer remote from the swath.

* * * * *